United States Patent [19]

Crutchfield et al.

[11] 4,201,687

[45] * May 6, 1980

[54] CHLOROIMIDE FABRIC BLEACHES

[75] Inventors: Marvin M. Crutchfield, Creve Coeur; Robert P. Langguth, Overland; James M. Mayer, Maryland Heights, all of Mo.

[73] Assignee: Monsanto Company, St. Louis, Mo.

[ * ] Notice: The portion of the term of this patent subsequent to Apr. 10, 1996, has been disclaimed.

[21] Appl. No.: 954,494

[22] Filed: Oct. 25, 1978

Related U.S. Application Data

[63] Continuation-in-part of Ser. No. 838,279, Sep. 30, 1977, Pat. No. 4,148,742.

[51] Int. Cl.[2] ..... C11D 7/54; 424 149

[52] U.S. Cl. ..... 252/102; 252/99; 252/95; 252/187 H; 252/187 R; 423/383; 423/479; 424/149

[58] Field of Search ..... 252/102, 99, 95, 187 H, 252/187 R; 423/383, 386, 479

[56] References Cited

U.S. PATENT DOCUMENTS

| | | | |
|---|---|---|---|
| 3,749,672 | 7/1973 | Golion et al. | 252/95 |
| 4,088,611 | 5/1978 | Suzuki et al. | 252/89 R |

FOREIGN PATENT DOCUMENTS

| | | | |
|---|---|---|---|
| 7119722 | 2/1971 | Japan | 252/95 |

OTHER PUBLICATIONS

Z. Anorg. Allgem. Chem. 147, 1–4 (1925), Raschig "Potassium Chlorimidodisulfonate".

*Primary Examiner*—Mayer Weinblatt

*Attorney, Agent, or Firm*—S. M. Tarter; E. P. Grattan; F. D. Shearin

[57] ABSTRACT

A fabric bleaching composition is provided which consists essentially of water and a bleach selected from the group consisting of disodium chloroimidodisulfate, dipotassium chloroimidodisulfate and mixtures thereof. The fabric bleaching composition can also contain a detergent, a buffering agent and other ingredients in a detergent formulation. The fabric bleaching composition is intermediate in strength between peroxide-type fabric bleaches and alkali metal hypochlorite fabric bleaches.

11 Claims, No Drawings

CHLOROIMIDE FABRIC BLEACHES

CROSS-REFERENCES TO RELATED APPLICATIONS

This application is a continuation-in-part of application Ser. No. 838,279, filed Sept. 30, 1977 now U.S. Pat. No. 4,148,742 issued Apr. 10, 1979.

FIELD OF THE INVENTION

This invention relates to fabric bleaches and more particularly, to chloroimide fabric bleaches. The invention also relates to the use of such chloroimide fabric bleaches in washing processes.

Detergent compositions containing a water-soluble detergent surfactant, and generally a builder which is used to sequester calcium and magnesium ions and to improve detergency levels of soaps and synthetic detergents, are widely used in home and industrial laundries for cleaning fabrics. Such detergent compositions may also contain fillers, such as sodium sulfate, and minor amounts of optical brighteners, soil antiredeposition agents, perfumes and the like. Although such detergent compositions effectively remove soil from fabrics, such as polyester, polyester/cotton, cotton and the like, certain stains on the fabric caused by tea, grape juice, red wine and the like, are very difficult to remove from fabrics using conventional detergent formulations.

To remove such stains it is a common laundry practice to add a bleach to aid in the removal of the stains from the fabric. The most common bleaches are the peroxide-type bleaches and the hypochlorite-type bleaches, such as sodium perborate and sodium hypochlorite, respectively. However, each of these bleaches suffer from certain disadvantages. The peroxide-type bleaches usually require an activator to be effective, particularly in cold or tepid water. On the other hand, the hypochlorite bleaches can effectively remove the stains, but such stain removal is frequently accompanied by some damage to the dyed fabric. Furthermore, it is often desirable, if not necessary, to segregate white clothes from colored clothes to minimize the deleterious effect of normal use levels of hypochlorite bleaches on colored fabrics.

Those skilled in the art of detergent formulations have long been interested in a material that is stronger than the peroxide-type bleaches and would act in cold or tepid water, but yet is not as strong as the hypochlorite-type bleaches that have a deleterious effect on dyes and fabrics, and yet have a desirable bleaching property. Now, a materal has been found that is intermediate in strength between alkali metal hypochlorite and peroxide-type bleaches, that is sufficiently strong to bleach most stains during washing, but is not so strong as to cause undue damage to colored fabrics. Such an improved laundry bleach permits the use of bleach with colored fabrics with reduced fear of damage to the color. Moreover, the necessity for separating colored fabrics from white fabrics during the washing and bleaching operation is reduced or even eliminated.

SUMMARY OF THE INVENTION

These and other advantages are achieved by a fabric bleaching composition which comprises water and a stain-bleaching amount of a bleach selected from the group consisting of disodium chloroimide disulfate, dipotassium chloroimide disulfate and mixtures thereof. The invention also contemplates a process of washing fabrics, such as clothing, which comprises contacting the fabric with an aqueous solution of a surfactant and a stain-bleaching amount of a bleach selected from the group consisting of disodium chloroimidodisulfate, dipotassium chloroimidodisulfate and mixtures thereof.

Broadly described, the dipotassium chloroimide disulfate or the disodium chloroimidodisulfate, or mixtures thereof, can be prepared by reacting diammonium imidodisulfate with the appropriate alkali metal hydroxide to form trialkali metal imidodisulfate with the evolution of ammonia. The resulting imidodisulfate is reacted with elemental chlorine to form the dialkali metal chloroimide disulfate. On the other hand, the trialkali metal imidodisulfate can be brought together with an alkali metal hypochlorite, such as sodium hypochlorite or potassium hypochlorite, to form the dialkali metal chloroimidodisulfate. This latter procedure can be used to make the chloroimide disulfate either in situ in the wash water, or beforehand, and then add the chloroimide to the wash water. The resulting solution of chloroimide is useful as a bleach to remove stains from soiled fabrics. Since the chloroimide is intermediate in strength between hypochlorite and the peroxide-type bleaches commonly used in washing processes, the chloroimide is strong enough to remove stains from the soiled fabric but yet is not so strong as to unduly damage the dyes in the fabric or the fabric itself.

Other chlorine-containing compounds outside the scope of the present invention were prepared and evaluated. Chlorine bleaches prepared from sodium sulfamate were only slightly better than sodium perborate as a bleach. Chlorine bleach prepared from paratoluene sulfonamide was poorer in performance than sodium perborate, and in certain washing tests, chlorine bleaches prepared from phthalamide, sodium imidodiacetate and succinimide gave bleaching performance poorer than when no bleach was added to the wash water. Such tests indicated that the disodium chloroimidodisulfate and the dipotassium chloroimidodisulfate of the present invention, and mixtures thereof, provided far superior results.

The amount of the chloroimide bleach of the present invention to provide a stain-bleaching amount in an aqueous solution can vary within wide limits. A saturated aqueous solution of the chloroimidodisulfate of the present invention, such as might be used for shipping, can be used directly on the fabric, particularly a white fabric, to bleach stains with less damage to the fabric than if concentrated hypochlorite solution were used. A saturated solution at room temperature of dipotassium chloroimidodisulfate contains about 15 weight percent chloroimide, whereas a saturated solution of disodium chloroimidodisulfate at room temperature contains about 28.8 weight percent chloroimide, based on the weight of the total solution. On the other hand, when a saturated solution of the chloroimidodisulfate of the present invention is added to wash water to provide a concentration of bleach equivalent to a use level of one cup (250 ml.) of hypochlorite per washer load (about 250 ppm, the recommended use level for American home laundries), the concentration of the chloroimidodisulfate of the present invention is about 750 parts per million in the wash water. Higher concentrations, of course, could be used, for example 1500 parts per million, for particularly stubborn stains on the fabric. However, as will occur to those skilled in the art in light of the present invention, as little as 10 parts per million or less of the chloroimidodisulfate bleach could be used in repeated washings to improve fabric brightness. Thus, it can be seen that between about 10 parts per million and a saturated solution will provide satisfactory results but it is preferred to use between about 10 and about 1500 ppm chloroimide in the aqueous solution.

The chloroimidodisulfate of the present invention is substantially stable in aqueous solutions maintained at pH 9 or higher, say about pH 10 to about pH 11, at ambient temperatures for several months. The term "substantially stable" as it is used in the specification and claims with respect to the chloroimidodisulfate, shall mean that the compound loses less than 5 percent of the available chlorine after 30 days at ambient temperature (about 23° C.). Although Applicants do not wish to be bound by any particular theory, it is believed that bisulfate is formed as one of the decomposition products when the chloroimidodisulfate loses its available chlorine, and the acid catalyzes subsequent decomposition of the chloroimidodisulfate.

In addition, the alkali metal chloroimidodisulfate of the present invention is most effective between about pH 9 and about pH 11. When the pH of the bleaching solution is below about pH 9, the bleach loses its effectiveness, and when the pH of the bleaching solution exceeds about pH 11, the bleach approaches the strength of hypochlorite. It is preferred to maintain the pH of the solution between about pH 9.8 and about pH 10.3.

The use of buffering agents to maintain the pH of the solution between about pH 9 and about pH 11 is preferred. Suitable buffering agents include magnesium oxide and hydroxide, calcium oxide and hydroxide, alkali metal carbonates, calcium carbonate, alkali metal aluminum silicates (sometimes known as zeolites) and the like. Mixtures of buffering agents can also be used. Other suitable buffering agents will occur to those skilled in the art in view of the present disclosure. Sodium carbonate and potassium carbonate are preferred.

The amount of buffering agent to maintain the pH between about pH 9 and pH 11 can vary within wide limits depending on the particular buffering agent selected and other ingredients in the formulation. At concentrations below about 2 weight percent, based on the weight of the chloroimidodisulfate, little improvement in long-term stability of the chloroimidodisulfate is seen, although there is some effect. Even though there is no theoretical upper limit to the amount of buffering agent that could be used, there is not seen to be an advantage to using more than 100 weight percent buffering agent, based on the weight of the chloroimidodisulfate. It is preferred to use between about 5 and about 50 weight percent buffering agent, say about 10 to about 25 weight percent, based on the weight of the chloroimidodisulfate.

The fabric bleaching composition of the present invention can also contain a detergent selected from the group consisting of anionic, nonionic, zwitterionic and amphoteric surfactants or mixtures thereof. The quantity of surfactant in the undiluted compositions of this invention will depend upon the surfactant chosen and the intended end use of the composition. In general, such compositions will contain from about 5 percent to about 50 percent surfactant by weight, although as much as 95 percent surfactant may be employed if desired. Upon dilution of the composition in the water for washing fabrics, the amount of surfactant in the washer will vary from about 100 parts per million to about 600 parts per million, depending upon the concentration of the surfactant, the use level and the like. For example, if the chloroimidodisulfate of the present invention is formed in situ during the washing process by contacting trisodium or tripotassium imidodisulfate with sodium hypochlorite at a use level of about 1 cup (250 ml.) per washer, about 200 parts per million available chlorine would be present in the wash water. Using a powder detergent formulation, containing about 20 percent surfactant at the recommended use level of about 300 ml. per washer load, the concentration of surfactant in the water would be about 300 parts per million.

Any number of water soluble anionic, nonionic, zwitterionic or amphoteric surfactants known to those skilled in the art can be used in the detergent compositions of the present invention. A summary of surfactants, their properties and uses, including surfactant mixtures, can be found in "Surface Active Agents, Their Chemistry and Technology" by A. M. Schwartz and J. W. Perry, Interscience Publishers, Inc., New York, New York (1949).

Examples of suitable anionic surfactants include soaps such as the salts of fatty acids containing about 9 to 20 carbon atoms, e.g., salts of fatty acids derived from coconut oil and tallow; alkylbenzene sulfonates—particularly linear alkylbenzene sulfonates in which the alkyl group contains from 10 to 16 carbon atoms; alcohol sulfates; ethoxylated alcohol sulfates, hydroxy alkyl sulfonates; alkyl sulfates and sulfonates; monoglyceride sulfates; acid condensates of fatty acid chlorides with hydroxy alkyl sulfonates; and the like.

Examples of suitable nonionic surfactants include alkylene oxide (e.g., ethylene oxide) condensates of mono- and polyhydroxy alcohols, alkyl phenols, sugar derivatives such as sucrose monopalmitate; long chain tertiary phosphine oxides, dialkyl sulfoxides, and the like.

Examples of suitable zwitterionic surfactants include derivatives of aliphatic quaternary ammonium compounds such as 3-(N,N-dimethyl-N-hexadecylammonio) propane-1-sulfonate and 3-(N,N-dimethyl-N-hexadecylammonio)-2-hydroxy propane-1-sulfonate.

Examples of suitable amphoteric surfactants include betains, sulfobetains and fatty acid imidazole carboxylates and sulfonates.

The selection of particular surfactants, builders, optical brighteners, soil antiredeposition agents, perfumes and other detergent ingredients, as well as optimum quantities of such ingredients, can be established by routine testing in accordance with conventional formulation practice known to those skilled in the art.

DESCRIPTION OF THE PREFERRED EMBODIMENTS

This invention is illustrated by, but not limited to, the following Examples wherein all percentages are by weight unless otherwise noted.

EXAMPLE I

Trisodium imidodisulfate was prepared by the method described by P. Baumgarten, Ber, 6913, 2929–2937 (1936). To 57 grams (0.5 mole) ammonium sulfamate in a 400 milliliter beaker was added 48.5 grams (0.5 mole) sulfamic acid. The solids in the beaker were heated on a hot plate. At about 120° C., a stirrable melt was obtained and at about 150° C., the melt began to solidify. The beaker was removed from the hot plate, and when the solid was cool, it was broken apart and dissolved in 128 grams of 50 percent sodium hydroxide to which water was added to bring the total volume to 450 milliliters. The solution was heated to expel ammonia, cooled to room temperature, and filtered. The solution was chilled to 5° C., and a seed crystal was added, whereupon a precipitate instantly formed. The precipitate was recovered by filtration and dried in vacuo at room temperature. Analysis showed that 82.6 grams of $NaN(SO_3Na)_2.H_2O$ was obtained.

ents. The wash water was at 120° F. (about 60° C.) and the cycle time was ten minutes.

The results, presented in Table 1, show that the chloroimidodisulfate gives much better efficacy to damage ratios when compared with the same level of sodium hypochlorite used as a bleach. The data show that at all bleach levels, the chloroimidodisulfate provided favorable bleaching. Although slightly higher bleaching can be obtained with sodium hypochlorite alone, the differences are not easily seen while the dye damage effects are obvious.

TABLE 1

FINAL YXZ VALUES FOR DAMAGE AND EFFICACY

| NaOCl | TSIS | Dye Damage | | | | | | | Bleaching Efficacy | | | | | | |
|---|---|---|---|---|---|---|---|---|---|---|---|---|---|---|---|
| | | Brown Cloth | | | Blue Jean | | | | Tea | | | Grape | | | |
| Level | Level | Y | X | Z | Y | X | Z | Σ | Y | X | Z | Y | X | Z | Σ |
| 0 ppm | ppm | 6.8 | 7.9 | 5.2 | 3.2 | 3.4 | 7.1 | 33.6 | 74 | 74 | 76 | 60 | 58 | 73 | 415 |
| | 750 | 6.7 | 7.8 | 5.1 | 3.1 | 3.2 | 6.7 | 32.6 | 72 | 72 | 73 | 68 | 67 | 78 | 430 |
| 50 | 0 | 8.3 | 9.7 | 6.5 | 3.9 | 4.1 | 6.8 | 39.3 | 87 | 85 | 94 | 70 | 69 | 74 | 479 |
| | 750 | 7.5 | 8.7 | 5.8 | 3.3 | 3.5 | 6.2 | 35.0 | 84 | 83 | 88 | 69 | 68 | 74 | 466 |
| 100 | 0 | 11.1 | 12.8 | 8.8 | 4.9 | 5.1 | 7.3 | 50.0 | 87 | 85 | 96 | 87 | 85 | 92 | 532 |
| | 750 | 7.1 | 8.2 | 5.5 | 3.2 | 3.3 | 6.0 | 33.3 | 87 | 84 | 93 | 82 | 80 | 85 | 511 |
| 125 | 0 | 13.1 | 15.1 | 10.6 | 5.5 | 5.9 | 7.8 | 58.0 | 87 | 86 | 97 | 87 | 85 | 93 | 536 |
| | 750 | 7.6 | 8.8 | 5.9 | 3.4 | 3.6 | 6.0 | 35.3 | 88 | 86 | 95 | 85 | 83 | 89 | 526 |
| 150 | 0 | 15.0 | 17.1 | 12.5 | 6.1 | 6.5 | 8.3 | 65.5 | 88 | 86 | 98 | 88 | 86 | 94 | 540 |
| | 750 | 9.3 | 10.7 | 7.2 | 4.2 | 4.4 | 6.9 | 42.7 | 88 | 86 | 95 | 85 | 83 | 89 | 526 |
| 175 | 0 | 15.7 | 17.9 | 13.0 | 7.5 | 8.1 | 9.2 | 71.4 | 88 | 86 | 97 | 88 | 86 | 95 | 540 |
| | 750 | 9.3 | 10.7 | 7.2 | 4.1 | 4.3 | 6.6 | 42.2 | 88 | 86 | 97 | 86 | 84 | 90 | 531 |
| 200 | 0 | 17.3 | 19.6 | 14.7 | 7.3 | 7.9 | 9.1 | 75.9 | 88 | 86 | 97 | 88 | 86 | 95 | 540 |
| | 750 | 10.1 | 11.7 | 7.8 | 4.5 | 4.8 | 6.9 | 45.8 | 88 | 86 | 97 | 85 | 83 | 90 | 529 |
| 300 | 0 | 22.1 | 24.7 | 19.3 | 12.1 | 13.2 | 13.1 | 104.5 | 87 | 85 | 96 | 88 | 86 | 96 | 538 |
| | 750 | 12.2 | 14.0 | 9.6 | 5.8 | 6.3 | 8.2 | 56.1 | 87 | 85 | 96 | 86 | 84 | 92 | 530 |

Y = green reflectance
X = red reflectance
Z = blue reflectance

EXAMPLE II

The trisodium imidodisulfate (TSIS) from Example I was used to prepare disodium chloroimidodisulfate in situ in a series of experiments to show the effectiveness of the bleach. A sufficient quantity of the TSIS from Example I was added to wash water so that at least a stoichiometric amount of TSIS was present for sodium hypochlorite bleach levels up to about 200 ppm available chlorine in the wash water. The sodium hypochlorite bleach was added before the fabric was added to the wash water. Two common stains, tea and grape juice, were chosen to test the bleach efficiency. To test damage, two fabrics with bleach sensitive dyes, i.e., blue denim and a brown cotton, were chosen to give the dyes and stains with similar colors (blue and brown). The dye damage tests were run for three cycles to give the data more precision. The bleach studies were run for various levels of bleach so that the effects of the disodiumchloroimidodisulfate could be compared at different bleach levels.

After washing, the swatches were read on a Gardner XL-23 Colorimeter. The XYZ values (percent reflectance of green, red and blue light, respectively) were read before and after washing. Since the dyes and stains were consistent, the ratio of initial values was similar. This allowed the final XYZ values to be compared directly.

To perform the tests, water containing 100 ppm hardness with a calcium to magnesium ratio of 3:2 was used with 1500 ppm of a typical commercial detergent. The detergent contained linear alkylbenzene sulfonate as the surfactant and sodium tripolyphosphate as a builder along with minor amounts of other detergent ingredi-

EXAMPLE III

Diammonium imidodisulfate was prepared by adding 114 grams (1.0 mole) of ammonium sulfamate to 97 grams (1.0 mole) of sulfamic acid in a 1-liter beaker. The mixture was heated on a hot plate with constant stirring. At about 130° C. a stirrable slurry was obtained and at about 155° C. an exothermic reaction began, forming a solid. When the solid cooled, it was dissolved in about 375 grams of 45 percent potassium hydroxide. Water was added to bring the total volume to 800 milliliters. The solution was filtered and then heated under vacuum to expel ammonia. Upon cooling, concentrated hydrochloric acid was carefully added to the solution to adjust the mixture to pH 7.5. A precipitate was obtained and upon filtering, about 150 grams of potassium imidodisulfate was obtained.

About 100 grams of the dipotassium salt and 51 grams of 45 percent potassium hydroxide were added to 500 grams water. Chlorine gas was added to the solution until it reached pH 7.5. Potassium hydroxide was added to adjust the pH to about pH 8.5. The solution was filtered and evaporated on a rotary evaporator until the solution became cloudy with precipitated crystals. The solution was cooled and the precipitate was recovered by filtration. The precipitate was dried overnight in a stream of dry air.

Analysis of a portion of the precipitate confirmed that the precipitate was $Cl.N(SO_3K)_2$. A potassium iodithiosulfate titration showed that the product contained about 23.8 percent available chlorine. Analysis by X-ray diffraction using a Phillips scanning X-ray diffractometer using CuKα radiation showed the following major spacings: 4.29; 4.39; 4.57; 4.63; 4.70; 5.73; 6.08; 6.45; 7.25; and 7.80 A.

The chloroimidodisulfate prepared above was used in a series of experiments to compare the bleaching effectiveness of the bleach of the present invention with sodium hypochlorite and sodium perborate, in accordance with the general procedure of Example II. The results, presented in Table 2 below, have been normalized to permit a ready comparison between the bleaches used.

TABLE 2

| Bleach | Performance Relative to NaOCl | |
|---|---|---|
| | Stain Removal | Dye Damage |
| None (detergent only) | 0 | O |
| NaOCl (200 ppm) | 100 | 100 |
| Cl . $N(SO_3K)_2$ . (200 ppm) | 75 | 20 |
| Sodium Perborate (500 ppm) | 15 | 5 |

EXAMPLE IV

The effect of the pH of the aqueous solution on the storage stability of disodium chloroimidodisulfate was measured by determining the percentage of available chlorine and measuring the available chlorine remaining after 28 days at different pH levels. The results are presented in Table 3 below.

TABLE 3

| Solution pH | Available Cl (% of original) |
|---|---|
| 9.3 | 93 |
| 9.7 | 95 |
| 10.0 | 97 |
| 10.2 | 99 |
| 10.4 | 95 |
| 10.8 | 83 |
| 11.0 | 75 |

EXAMPLE V

The effect of storage temperature on the stability of the disodium chloroimidodisulfate was compared with a commercially available sodium hypochlorite solution containing 5.25 percent available chlorine. The solutions were stored for 28 days at various temperatures and then analyzed to determine the available chlorine remaining as a percentage of the chlorine in the original solution. The results are presented in Table 4 below.

TABLE 4

| Storage Temperature (°C.) | Available Cl (% of Original) | |
|---|---|---|
| | Chloroimide | NaOCl |
| 25 | 95 | 94 |
| 37 | 90 | 62 |
| 50 | 43 | 28 |

Although the invention has been described in terms of specified embodiments which are set forth in considerable detail, it should be understood that this is by way of illustration only and that the invention is not necessarily limited thereto since alternative embodiments and operating techniques will become apparent to those skilled in the art in view of the disclosure. Accordingly, modifications are contemplated which can be made without departing from the spirit of the described invention.

What is claimed is:

1. A fabric bleaching composition comprising: water; a stain bleaching amount of a bleach selected from the group consisting of disodium chloroimidodisulfonate, dipotassium chloroimidodisulfonate, and mixtures thereof; and a sufficient amount of a buffering agent to maintain the pH between about pH 9 and pH 11.

2. A composition of claim 1 wherein the amount of bleach is at least 10 ppm.

3. A composition of claim 1 wherein the amount of bleach is between about 10 ppm and about 15 weight percent, based on the weight of the composition.

4. A composition of claim 1 wherein the amount of bleach is between about 10 ppm and about 1500 ppm.

5. A composition of any of claims 1 through 4 wherein the bleach is disodium chloroimidodisulfonate.

6. A composition of claim 1 wherein the composition contains a water soluble detergent selected from the group consisting of anionic, nonionic, zwitterionic and amphoteric surfactants, or mixtures thereof.

7. A composition of claim 6 wherein the amount of detergent is between about 100 ppm and 95 weight percent, based on the weight of the composition.

8. A composition of claim 6 wherein the detergent is an anionic surfactant.

9. A composition of claim 6 wherein the detergent is a nonionic surfactant.

10. A composition of claim 1 or 6 wherein the amount of buffering agent is between about 10 weight percent and about 25 weight percent, based on the weight of the bleach.

11. A composition of claim 1 or 6 wherein the buffering agent is an alkali metal carbonate.

* * * * *